US006379394B1

(12) United States Patent
Chilou et al.

(10) Patent No.: US 6,379,394 B1
(45) Date of Patent: Apr. 30, 2002

(54) SOIL-REPELLENT AGENT AND PROCESS FOR THE TREATMENT OF ARTICLES BASED ON WOVEN COTTON

(75) Inventors: Emmanuelle Chilou; Kenneth Wong, both of Paris; Jean-Pierre Marchand, Lyons; Claire David, Saint Cyr sur Loire; Etienne Fleury, Irigny, all of (FR)

(73) Assignee: Rhodia Chimie, Boulogne Billancourt Cedex (FR)

( * ) Notice: Subject to any disclaimer, the term of this patent is extended or adjusted under 35 U.S.C. 154(b) by 0 days.

(21) Appl. No.: 09/631,657

(22) Filed: Aug. 3, 2000

Related U.S. Application Data

(63) Continuation of application No. 09/117,954, filed as application No. PCT/FR97/00304 on Feb. 19, 1997.

(30) Foreign Application Priority Data

Feb. 20, 1996 (FR) ..... 96 02181

(51) Int. Cl.[7] ..... D06L 1/12

(52) U.S. Cl. ..... 8/137; 510/517; 510/519; 510/520; 510/521; 510/526; 510/528

(58) Field of Search ..... 8/137; 510/528, 510/517, 519, 520, 521, 526

(56) References Cited

U.S. PATENT DOCUMENTS 4,738,787 A * 4/1988 O'Lenick, Jr.

* cited by examiner

*Primary Examiner*—Margaret Einsmann
(74) *Attorney, Agent, or Firm*—Jean-Louis Seugnet

(57) ABSTRACT

A soil-repellent treatment method for articles based on woven cotton, wherein an amphiphilic soil-repellent agent soluble or dispersible in the treatment medium is deposited on the article during one or more washing, rinsing and/or softening or dying steps, is disclosed. Said soil-repellent agent comprises at least one unit with a function (FAd) capable of being absorbed onto the surface of the cotton by electrostatic interaction; and at least one hydrophobic unit (MH) capayble of configuring said agent at the cotton/water interface. A soil-repellent agent comprising at least one unit with a cationic function (MC) capable of being absorbed onto the surface of the cotton, and the counter-ion thereof, as well as at least one hydrophobic unit (MH) containing at least four carbon atom chemically bonded to the unit having said cationic function (MC) via an oligomeric, polymeric or copolymeric vinyl alcohol chain, is also disclosed.

20 Claims, No Drawings

SOIL-REPELLENT AGENT AND PROCESS FOR THE TREATMENT OF ARTICLES BASED ON WOVEN COTTON

This application is a continuation application of application Ser. No. 09/117,954 filed on Aug. 10, 1998 a Nat'l stage of PCT/FR97/00304, filed Feb. 19, 1997.

The subject of the present invention is a process for the soil-release treatment of articles based on woven cotton by depositing a soil-release agent on the said article in the course of a washing, rinsing and/or softening or drying operation(s), and a soil-release agent for articles based on woven cotton.

A first subject of the invention consists of a process for the soil-release treatment of articles based on woven cotton by depositing, in the course of a washing, rinsing and/or softening or drying operation(s), an amphiphilic soil-release agent on the said article, the said soil-release agent being soluble or dispersible in the treatment medium and having

- at least one unit carrying a functional group (FAd.) capable of being adsorbed onto the surface of the cotton by electrostatic interaction
- and at least one unit having a hydrophobic character (MH) capable of configuring the said agent at the cotton/water interface, it being possible for the said unit (MH) itself to be one of the constituents of the unit carrying a functional group (FAd.) or to be chemically bonded to the unit carrying a functional group (FAd.) via a hydrophilic chain, the said soil-release agent being employed during washing by means of a washing formulation, during rinsing and/or softening by means of a rinsing and/or softening formulation or during drying by means of an absorbent support.

According to the invention, the said process makes it possible to treat, against soil, articles made of woven cotton fibres; this process in also suitable for the treatment of articles consisting of a mixture of cotton fibres and of other, natural, artificial or synthetic, fibres such as viscose, polyesters, polyacrylic fibres . . . , it being possible for the fibres other than cotton to represent up to 65% of the mixture of fibres.

Preferably, the said unit carrying a functional group (FAd.) is a functional group having a cationic character (MC) capable of being adsorbed onto the surface of the cotton and its counter-ion.

It is therefore preferably a process for the soil-release treatment of articles based on woven cotton by depositing, in the course of a washing, rinsing and/or softening or drying operation(s), an amphiphilic soil-release agent on the said article, the said soil-release agent being soluble or dispersible in the treatment medium and having

- at least one unit carrying a functional group having a cationic character (MC) capable of being adsorbed onto the surface of the cotton and its counter-ion
- and at least one unit having a hydrophobic character (MH) capable of configuring the said agent at the cotton/water interface, it being possible for the said unit (MH) itself to be one of the constituents of the unit carrying a functional group having a cationic character (MC), by chemically bonding to the heteroatom of the unit (MC), or to be chemically bonded to the unit carrying a functional group having a cationic character (MC) via a hydrophilic chain, the said soil-release agent being employed during washing by means of a washing formulation, during rinsing and/or softening by means of a rinsing and/or softening formulation or during drying by means of an absorbent support.

The expression "functional group having a cationic character (MC)" should be understood to mean any functional group which is either cationic as it is or having an electrophilic atom.

Among functional groups having a cationic character, mention may be made of ammonium and phosphonium groups, groups derived from Lewis bases such am primary, secondary or tertiary amines, betaines, sultaines, glycinates . . .

The expression "unit having a hydrophobic character (MH) capable of configuring the soil-repellent agent at the cotton/water interface" should be understood to mean any unit which, in the treatment medium, favours the partition of the soil-release molecule between the water and the surface of the article based on woven cotton. These units having a hydrophobic character make it possible to increase, at least locally, the thickness of the surface layer of electrostatic charges on the cotton. Preferably, these units having a hydrophobic character are also capable of interacting with components of the soil.

The counter-ions capable of forming a malt with the said cationic functional groups may be of any nature. Mention may be made of halide ($Cl^-$, $Br^-$, . . . ) ions, acetate ions, sulphate ions, sulphonate ions, phosphate ions . . .

Among the preferred counter-ions, mention may be made in particular of $Br^-$ and $Cl^-$ ions.

Among units having a hydrophobic character (MH), mention may be made of hydrocarbon groups, such as alkyls, alkenyls, which may be linear, branched or cyclic, aryls . . . containing at least 4 carbon atoms and preferably from 8 to 20 carbon atoms. Mention may most particularly be made of $C_4$–$C_{20}$ alkyl groups.

The said unit having a hydrophobic character (MH) may itself be one of the substituents of the heteroatom of the unit carrying a functional group having a cationic character (MC), or may be chemically bonded to the said unit (MC) via a hydrophilic chain.

Among hydrophilic chains mention may be made of hydrophilic oligomer or polymer chains consisting of similar or different oligomer or polymer units from those derived from

- polysaccharides (guar, cellulose derivatives, alginates, starch derivatives . . . )
- polyoxyalkylene glycols (polyoxyethylene glycols . . . )
- copolyesters, especially terephthalic copolyesters (ethylene terephthalate/poly(oxyethylene) terephthalate copolymers . . . )
- sulphonated, especially terephthalic copolyesters (copolymers derived from terephthalic, isophthalic or sulphoisophthalic acids, anhydrides or diesters and from a diol . . . )
- polyvinyl alcohols and their copolymers
- acrylic polymers and copolymers
- . . .

optionally carrying hydrophilic functional groups such as sulphonate, carboxylate, phosphate . . .

The amounts of units carrying functional groups having a cationic character (MC) are such that they ensure, during the treatment, sufficient binding of the soil-release agent molecule to the surface of the cotton article.

Amounts of about 0.1 to 40 parts by weight of cationic functional groups per 100 parts by weight of soil-repellent agent are generally satisfactory. In the case of ammonium functional groups, these may represent about 0.01 to 4 grams of nitrogen per 100 grams of soil-release agent.

The amounts of units having a hydrophobic character (MH) are such that, during the treatment, they ensure that the soil-repellent molecule is in hydrophilic/hydrophobic balance (HLB) enabling it to partition between the water and the surface of the article based on woven cotton. An HLB of greater than 15 is generally satisfactory.

The hydrophilicity of the soil-release molecule is such that the latter can be removed during the next washing at the same time as the moil.

Among amphiphilic soil-release agents which may be employed, mention may be made in particular of cationic surfactants and oligomers or polymers formed from a hydrophilic hydrocarbon oligomer or polymer backbone having, within its chain or as branches, units carrying a functional group having a cationic character (MC) with its counter-ion and units having a hydrophobic character (MH).

Among cationic surface-active soil-release agents, mention may be made in particular of those of formula:

$$R^1R^2R^3R^4N^+X^-$$

where $R^1$, $R^2$ and $R^3$ are similar or different and represent H or an alkyl radical containing less than 4 carbon atoms, preferably 1 or 2 carbon atoms, $R^4$ represents an alkyl radical containing more than 4 carbon atoms, preferably about 8 to 20 carbon atoms and $X^-$ is a halide, preferably bromide, ion, acetate ion, sulphate ion . . .

Mention may be made most particularly of dodecyltrimethylammonium, tetradecyltrimethylammonium and cetyltrimethylammonium bromides.

Among oligomeric or polymeric soil-release agents, mention may be made in particular of cationic alkyl guars and cationic alkyl hydroxypropyl guars.

Mention may also be made, by way of novel industrial product constituting a second subject of the invention, of an oligomeric, polymeric or copolymeric soil-repellent agent having at least one unit carrying a functional group having a cationic character (MC) capable of being adsorbed onto the surface of the cotton and its counter-ion and at least one unit having a hydrophobic character (MH) containing at least 4 carbon atoms, preferably from 8 to 20 carbon atoms, capable of configuring the said agent at the cotton/water interface, chemically bonded to the unit carrying a functional group hating a cationic character (MC) via a hydrophilic chain consisting of an oligomer, polymer or copolymer of vinyl alcohol.

Preferably, the functional groups having a cationic character (MC) are ammonium functional groups of formula:

$$R^1R^2R^3N^+—$$

where $R^1$, $R^2$ and $R^3$ are similar or different and represent H or an alkyl radical containing less than 4 carbon atoms, preferably 1 or 2 carbon atoms, optionally substituted, especially by one or more hydroxyl functional groups, or else together form, with the nitrogen atom $N^+$, at least one aromatic or non-aromatic ring, the said functional groups having a cationic character (MC) being chemically bonded to the oligomer, polymer or copolymer chain of the polyvinyl alcohol directly by a C—C bond or indirectly via a divalent or polyvalent hydrocarbon group containing at least one heteroatom. Among functional groups having a cationic character (MC), mention may in particular be made of those derived from glycidyltrimethylammonium chloride or bromide, or (1-chloro-2-hydroxypropyl) trimethylammonium chloride. Among divalent or polyvalent hydrocarbon groups containing at least one heteroatom, mention may be made of those having an other free bond, an ester free bond, a urethane free bond, an acetal free bond, an amide free bond . . . Among counter-ions capable of forming a salt with these functional groups having a cationic character, mention may be made of halide ($Cl^-$, $Br^-$, . . . ) ions, acetate ions, sulphate ions, sulphonate ions, phosphate ions Among units having a hydrophobic character (MH), mention may be made of linear or branched, preferably linear, alkyl radicals containing from 8 to 20 carbon atoms, it being possible for these to be chemically bonded to the oligomer, polymer or copolymer chain of the polyvinyl alcohol directly by a C—C bond or indirectly via a divalent or polyvalent hydrocarbon group containing at least one heteroatom. Among divalent or polyvalent hydrocarbon groups containing at least one heteroatom, mention may be made of those having an other free bond, an aster free bond, a urethane free bond, an acetal free bond, an amide free bond . . . Preferably, the said agent contains about 0.1 to 10, preferably from 1 to 6, units carrying a functional group having a cationic character (MC) per 100 monomer units of the oligomer, of the polymer or of the copolymer of polyvinyl alcohol and from 0.01 to 10, preferably from 0.1 to 5, units having a hydrophobic character (MH) per 100 monomer units of the polyvinyl alcohol polymer or copolymer. Among vinyl alcohol oligomers, polymers and copolymers constituting the hydrophilic chain, mention may be made of those having a molecular mass of about 500 to 500,000, preferably of about 1000 to 100,000; the said copolymers may contain up to 5 mol % of units derived from at least one comonomer, such as vinyl acetate, ethylene, maleic anhydride . . .

The said soil-release agent forming the subject of the invention may be obtained, for example, by modification of a homopolymer or of a copolymer of vinyl acetate, at least partially hydrolyzed into (co)polyvinyl alcohol (i.e. hydrolyzed to at least 80%) by grafting using compounds which are precursors of the units carrying a cationic functional group (MC) and of the hydrophobic units (MH); this modification by grafting involves substitution reactions (for example, esterification, acetalization, etherification . . . ) well known to those skilled in the art and described, in particular, in "Polyvinyl Alcohol Developments"—Ed. C. A. Finch (Wiley)—pages 183 et seq. and 84 et seq. It may also be prepared by radical copolymerization of vinyl acetate and of comonomers which are precursors of the units carrying a cationic functional group (MC) and of the hydrophobic units (MH), followed by hydrolysis (deacetalization). This type of process in also well known to those skilled in the art and described in "Polyvinyl Alcohol Developments"—Ed. C. A. Finch (Wiley). Thus, one particular soil-release agent may be obtained by modification of a polyvinyl alcohol using (2,3-epoxypropyl)trimethylammonium chloride followed by a modification using an alkylisocyanate.

The amounts of soil-release agent which can be used according to the treatment method of the invention depend on the nature of the molecule employed. The said amounts may be of about 0.05 to 5 grams per litre of treatment medium.

According to the invention, the soil-release agent may be employed in the course of a washing operation by means of a powder or liquid washing formulation (detergent composition), the treatment medium consisting of the washing bath. The powder or liquid detergent compositions may contain of about 0.02 to 20% of their weight of the said soil-release agent.

Present alongside the said soil-release agent may be other additives of the type described below:

SURFACTANTS, in amounts corresponding to approximately 3–40% by weight with respect to the detergent composition, these surfactants being such as:

Anionic Surfactants alkyl ester sulphonates of formula R—CH($SO_3$M)—COOR', where R represents a $C_{8-20}$, preferably $C_{10}$–$C_{16}$, alkyl radical, R' represents a $C_1$–$C_6$, preferably $C_1$–$C_3$, alkyl radical and M represents an alkali-metal (sodium potassium, lithium) or ammonium cation, which may or may not be substituted (methyl-, dimethyl-, trimethyl-, tetraethylammonium, dimethylpiperidinium . . . ) or a derivative of an alkanolamine (monoethanolamine, diethanolamine, triethanolamine . . . ). Mention may most particularly be made of methyl enter sulphonates in which the radical R is $C_{14}$–$C_{16}$;

alkyl sulphates of formula R$OSO_3$M, where R represents a $C_5$–$C_{24}$, preferably $C_{10}$–$C_{18}$, alkyl or hydroxyalkyl radical, M representing a hydrogen atom or a cation of the same definition as above, an well as their ethoxylated (EO) and/or propoxylated (PO) derivatives, having on average from 0.5 to 30, preferably from 0.5 to 10, EO and/or PO units;

alkylamide sulphates of formula RCONHR' $OSO_3$M where R represents a $C_2$–$C_{22}$, preferably $C_6$–$C_{20}$, alkyl radical, R' represents a $C_2$–$C_3$ alkyl radical, M representing a hydrogen atom or a cation of the same definition as above, as well as their ethoxylated (EO) and/or propoxylated (PO) derivatives having on average from 0.5 to 60 EO and/or PO units;

saturated or unsaturated $C_8$–$C_{24}$, preferably $C_{14}$–$C_{20}$, fatty acid salts, $C_9$–$C_{20}$ alkylbenzene sulphonates, primary or secondary $C_8$–$C_{22}$ alkyl sulphonates, alkyl glycerol sulphonates, sulphonated polycarboxylic acids described in GB-A-1,082,179, paraffin sulphonates, N-acyl-N-alkyltaurates, alkyl phosphates, isethionates, alkyl succinamates, alkyl sulphosuccinates, monoesters or diesters of sulphosuccinates, N-acyl sarcosinates, sulphates of alkyl glycosides, polyethoxycarboxylates the cation being an alkali metal (sodium, potassium, lithium), an ammonium residue, which may or may not be substituted (methyl-, dimethyl-, trimethyl-, tetramethylammonium, dimethylpiperidinium . . . ), or a derivative of an alkanolamine (monoethanolamine, diethanolamine, triethanolamine . . . );

Nonionic Surfactants polyalkoxylated (polyethoxylated, polypropoxylated, polybutoxylated) alkylphenols, the alkyl substituent of which is $C_6$–$C_{12}$ and containing from 5 to 25 oxyalkylene units; by way of example, mention may be made of TRITON X-45, X-114, X-100 or X-102 sold by R öhm & Haas;

glucosamide, glucamide, glycerolamide;

polyalkoxylated $C_8$–$C_{22}$ aliphatic alcohols containing from 1 to 25 oxyalkylene (oxyethylene, oxypropylene) units; by way of example, mention may be made of TERGITOL 15-S-9, TERGITOL 24-L-6 NMW, sold by Union Carbide Corp., NEODOL 45-9, NEODOL 23-65, NEODOL 45-7 and NEODOL 45-4 sold by Shell Chemical Company, and KYRO EOB sold by The Procter & Gamble Company.

the products resulting from the condensation of ethylene oxide, the compound resulting from the condensation of propylene oxide with propylene glycol, such as the PLURONICs sold by BASF;

the products resulting from the condensation of ethylene oxide, the compound resulting from the condensation of propylene oxide with ethylenediamine, such as the TETRONICs sold by BASF;

amine oxides such as $C_{10}$–$C_{18}$ alkyldimethylamine oxides and $C_8$–$C_{,22}$ alkoxydihydroxyethylethylamine oxides;

the alkyl polyglycosides described in U.S. Pat. No. 4,565,647;

$C_8$–$C_{20}$ fatty acid amides ethoxylated fatty acids ethoxylated fatty amides ethoxylated amines Amphoteric and Zwitterionic Surfactants alkyldimethylbetaines, alkylamidopropyldimethylbetaines, alkyltrimethylsulphobetaines, and products of the condensation of fatty acids and protein hydrolysates;

alkylamphoacetates or alkylamphodiacetates, the alkyl group of which contains from 6 to 20 carbon atoms.

ADJUVANTS IMPROVING THE PROPERTIES OF SURFACTANTS (BUILDER AGENTS), in amounts corresponding to approximately 5–50%, preferably approximately 5–30% by weight in the case of the liquid detergent formulations, or approximately 10–80%, preferably 15–50% by weight in the case of the powder detergent formulations, builder agents such as:

Inorganic Builder Adjuvants alkali-metal, ammonium or alkanolamine polyphosphates (tripolyphosphates, pyrophosphates, orthophosphates, hexametaphosphates);

tetraborates or borate precursors;

silicates, in particular those having an $SiO_2/Na_2O$ ratio of from 1.6/1 to 3.2/1, and the lamellar silicates described in U.S. Pat. No. 4,664,839;

alkali-metal or alkaline-earth metal carbonates (bicarbonates and sesquicarbonates);

cogranulates of hydrated alkali-metal silicates and of alkali-metal (sodium or potassium) carbonates rich in silicon atoms in the Q2 or Q3 form, theme being described in EP-A-488,868;

crystalline or amorphous alkali-metal (sodium, potassium) or ammonium aminosilicates, such as zeolites A, P, X . . . ; zeolite A having a particle size of about 0.1–10 micrometres in preferred.

Organic Builder Adjuvants water-soluble polyphosphonates (1-hydroxy-1-ethane-1-diphosphonates, salts of methylene diphosphonates. . . )

water-soluble salts of carboxylic polymers or copolymers or their water-soluble salts such as:

polycarboxylate others (oxydisuccinic acid and its salts, tartrate monosuccinic acid and its salts, tartrate disuccinic acid and its salts hydroxypolycarboxylate others citric acid and its salts, mellitic acid, succinic acid and their salts salts of polyacetic acid& (ethylenediamine-tetraacetates, nitrilotriacetates, N-(2-hydroxyethyl) nitrilodiacetates)

$C_5$–$C_{20}$ alkyl succinic acids and their salts (2-dodecenyl succinates, lauryl succinates)

carboxylic polyacetal esters polyaspartic acid, polyglutamic acid and their salts polyimides derived from the polycondensation of aspartic acid and/or of glutamic acid polycarboxymethylated derivatives of glutamic acid or of other amino acids.

BLEACHING AGENTS, in amounts of approximately 0.1–20%, preferably approximately 1–10% by weight, optionally combined with BLEACHING ACTIVATORS, in quantities of approximately 0.1–60%, preferably approximately 0.5–40% by weight, theme agents and activators being such as Bleaching Agents perborates, such as sodium perborate monohydrate or sodium perborate tetrahydrate peroxy compounds such as sodium carbonate peroxyhydrate, pyrophosphate peroxyhydrate, urea hydrogen peroxide, sodium peroxide, sodium persulphate, preferably combined with a bleaching activator generating, in situ in the detergent washing medium, a carboxylic peroxyacid; among these activators, mention may be made of tetraacetylethylenediamine, tetraacetylmethylenediamine, tetraacetylglycoluryl, sodium p-acetoxybenzene sulphonate, pentaacetyl glucose, octaacetyl lactose percarboxylic acids and their salts (called "percarbonates") such am magnesium monoperoxyphthalate hexahydrate, magnesium metachloroperbenzoate, 4-nonylamino-4-oxoperoxybutyric acid, 6-nonylamino-6-oxoperoxycaproic acid, diperoxydodecanedioic acid, the nonylamide of peroxysuccinic acid, decyldiperoxy-succinic acid.

These agents may be combined with at least one of the soil-release or anti-redeposition agents mentioned below. Non-oxygenated bleaching agents, acting by photoactivation in the presence of oxygen, such as sulphonated aluminium and/or zinc phthalocyanines, may also be mentioned.

Other SOIL-RELEASE AGENTS, in amounts of approximately 0.01–10%, preferably approximately 0.1–5% and most particularly about 0.2–3% by weight, these agents being such an cellulose derivatives such an cellulose hydroxy-ethers, methyl cellulose, ethyl cellulose, hydroxypropyl methyl cellulose, hydroxybutyl methyl cellulose polyvinyl esters grafted onto polyalkylene backbones, such as polyvinyl acetates grafted onto polyoxyethylene backbones (EP-A-219,048)

polyvinyl alcohols polyester copolymers based on ethylene terephthalate and/or propylene terephthalate and polyoxyethylene terephthalate units, with an ethylene terephthalate and/or propylene terephthalate (number of units)/polyoxyethylene terephthalate (number of units) molar ratio of about 1/10 to 10/1, preferably of about 1/1 to 9/1, the polyoxyethylene terephthalates having polyoxyethylene units with a molecular weight of about 300 to 5000, preferably of about 600 to 5000 (U.S. Pat. Nos. 3,959,230, 3,893,929, 4,116,896, 4,702,857 and 4,770,666);

sulphonated polyester oligomers obtained by sulphonation of an oligomer derived from ethoxylated allyl alcohol, dimethyl terephthalate and 1,2-propylene diol, having from 1 to 4 sulphonated groups (U.S. Pat. No. 4,968,451)

polyester copolymers based on propylene terephthalate and polyoxyethylene terephthalate units, these being terminated by ethyl or methyl units (U.S. Pat. No. 4,711,730), or polyester oligomers terminated by alkylpolyethoxy groups (U.S. Pat. No. 4,702,857) or sulphopolyethoxy anionic groups (U.S. Pat. No. 4,721,580), sulphoaroyl anionic groups (U.S. Pat. No. 4,877,896)

sulphonated polyester copolymers derived from a terephthalic, isophthalic and sulphoisophthalic acid, anhydride or diester and from a diol (FR-A-2,720,399)

ANTI-REDEPOSITION AGENTS, in amounts of approximately 0.01–10% by weight in the came of a powder detergent composition and approximately 0.01–5% by weight in the came of a liquid detergent composition, these agents being such as ethoxylated monoamines or polyamines, polymers of ethoxylated amines (U.S. Pat. No. 4,597,898, EP-A-11,984)

carboxymethyl cellulose sulphonated polyester oligomers obtained by the condensation of isophthalic acid, of dimethyl sulphosuccinate and of diethylene glycol (FR-A-2,236,926)

polyvinylpyrrolidones

CHELATING AGENTS for iron and magnesium, in amounts of about 0.1–10%, preferably about 0.1–3% by weight, theme agents being such an aminocarboxylates such an ethylenediaminetetraacetates, hydroxyethylethylenediaminetriacetates, nitrilotriacetates aminophosphonates, such as nitrilotris(methylene) phosphonates polyfunctional aromatic compounds such as dihydroxydisulphobenzenes POLYMERIC DISPERSING AGENTS, in amounts of about 0.1–7% by weight, in order to control the calcium and magnesium hardness, theme agents being such as water-soluble salts of polycarboxylic acids with a molecular mass of about 2000 to 100,000, obtained by polymerization or copolymerization of ethylenically unsaturated carboxylic acids such as acrylic acid, maleic acid or anhydride, fumaric acid, itaconic acid, aconitic acid, mesaconic acid, citraconic acid, methylenemalonic acid and, most particularly, polyacrylates with a molecular mass of about 2000 to 10,000 (U.S. Pat. No. 3,308,067), copolymers of acrylic acid and of maleic anhydride with a molecular mass of about 5000 to 75,000 (EP-A-66,915)

polyethylene glycols with a molecular mass of about 1000 to 50,000

FLUORESCENT AGENTS (BRIGHTENERS), in amounts of about 0.05–1.2% by weight, these agents being such as stilbene derivatives, pyrazoline, coumarin, fumaric acid, cinnamic acid, azoles, methinecyanines, thiophenes . . . ("The production and application of fluorescent brightening agents"—M. Zahradnik, published by John Wiley & Sons, New York—1982)

FOAM-SUPPRESSING AGENTS, in amounts which can range up to 5% by weight, these agents being such as $C_{10}$–$C_{24}$ monocarboxylic fatty acids or their alkali-metal or ammonium salts, or alkanolamines, triglycerides of fatty acids aliphatic, alicyclic, aromatic or heterocyclic saturated or unsaturated hydrocarbons, such as paraffins, waxes N-alkylaminotriazines monostearyl phosphates, monostearyl alcohol phosphates polyorganosiloxane, oils or residues, optionally combined with silica particles SOFTENING AGENTS, in amounts of approximately 0.5–10% by weight, those agents being such am clays ENZYMES, in amounts which can range up to 5 mg by weight, preferably about 0.05–3 mg of active enzyme per gram of detergent composition, these enzymes being such as proteases, amylases, lipases, cellulases, peroxydases (U.S. Pat. Nos. 3,553,139, 4,101,457, 4,507,219 and 4,261,868)

OTHER ADDITIVES such as alcohols (methanol, ethanol, propanol, isopropanol, propanediol, ethylene glycol, glycerine)

buffer agents perfumes pigments.

The soil-release agent may also be employed during rinsing and/or softening by means of a liquid formulation for rinsing and/or softening articles, the treatment medium consisting of the rinsing and/or softening bath. The liquid rinsing and/or softening compositions may contain about 0.02 to 20% of their weight of the said soil-release agent.

Present alongside the said soil-repellent agent may be other additives of the type combinations of anionic surfactants (laurylether sulphate . . . ), nonionic surfactants (ethoxylated fatty alcohols . . . ) and cationic surfactants (diester of triethanolamine quaternized by dimethyl sulphate, N-methylimidazoline tallow aster methyl sulphate . . . )

optical brighteners enzymes.

According to the invention, the soil-release agent may also be introduced during drying in the wet laundry to be dried, by means of a support consisting, for example, of a strip of non-woven textile-impregnated with the said soil-release agent, it being possible for this support to contain approximately 20% of its weight of soil-repellent agent.

The following examples are given by way of illustration.

Formulation of a washing machine detergent composition

| Composition of the detergent | Parts by weight |
|---|---|
| zeolite 4A | 25 |
| light carbonate | 15 |
| R2A disilicate | 5 |
| acrylic/maleic copolymer, SOKALAN CP5 (BASF) | 5 |
| Na sulphate | 10.7 |
| carboxymethyl celluloee | 1 |
| perborate monohydrate | 15 |
| tetraacetylethylenediamine | 5 |
| linear dodecylbenzenesulphonate | 6 |
| SYNPERONIC A3 ($C_{12}$–$C_{15}$ fatty alcohol ethoxylated to 3 EO | 3 |
| SYNPERONIC A9 ($C_{12}$–$C_{15}$ fatty alcohol ethoxylated to 9 EO | 9 |
| enzyme, Esperase 4.0 T | 0.3 |

Soil-Repellent Properties

Test

Rinsing pretreatment of the cotton: Four CN1 cotton test pieces of size 10×12 cm are used. Two test pieces, already washed, are introduced into a TERGOTOMETER; the powder soil-release agent is added followed by 1 litre of water (30°TH). The rinsing pretreatment in carried out at 100 cycles/minute for 20 minutes at 40° C. The other two test pieces are used as reference and pretreated in water alone (30°Th)

Staining 4 drops of used engine oil are deposited on the prewashed test pieces and, so as to ensure that the stain is properly fixed, the fabrics are placed in an oven at 60° C. for 1 hour.

Washing

The washing is carried out at 40° C. for 20 minutes using 5 g of the washing detergent described above per litre of water of 30°TH, then 3 rinses of 5 minutes in cold water and 2 dryings under a glazing machine.

Evaluation

The reflectance of the fabrics before and after washing is measured using a DR. LANGE/LUCI 100 calorimeter. The efficacy of the soil-release agent tested is assessed by the stain removal % calculated using the formula:

$$E\text{in } \% = 100 \times (R3 - R2)/(R1 - R2)$$

R1 representing the reflectance, before washing, of the non-soiled fabric

R2 representing the reflectance, before washing, of the soiled fabric

R3 representing the reflectance, after washing, of the soiled fabric.

For each product tested, the average of the stain removal % in calculated.

EXAMPLES 1 AND 2

The soil-repellent agents tested are:

cetyltrimethylmmonium bromide (CTAB) having an HLB of 24, in an amount of 0.1 g/l of water tetradecyltrimethylammonium bromide (TTAB) with an HLB of 14, in an amount of 1 g/l of water.

The results observed on the pretreated test pieces, compared with those observed on the reference test pieces, are as follows:

| Test pieces tested | E in % |
|---|---|
| Reference test pieces | 57 |
| CTAB-treated test pieces | 68 |
| TTAB-treated test pieces | 72 |

EXAMPLE 3

The soil-release agent tested in a cationic alkyl guar (CAG) having a viscosity, at 1% in water, of 1000 mPa.s, containing 1.7% by weight of nitrogen derived from hydroxypropyltrimethylammonium chloride and having alkyl groups derived from the epoxide of formula;

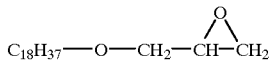

It is used in an amount of 2 g/l of water. The results observed on the pretreated test pieces, compared with those observed on the reference test pieces, are as follows:

| Test pieces tested | E in % |
|---|---|
| Reference test pieces | 57 |
| CAG-treated test pieces | 65 |

EXAMPLE 4

Synthesis of a Polyvinyl Alcohol (PVOH) Modified by Units Carrying a Cationic Functional Group and by Units having a Hydrophobic Character Modification by Units Carrying a Cationic Functional Group 40 g of polyvinyl alcohol of 15,000 molar mass and having a degree of hydrolysis of 88% are introduced into a three-necked round-bottomed flask. The polymer is then dissolved, under an inert atmosphere, in 200 g of water at 40° C. Next, 5.2 g of sodium hydroxide in pellet form are introduced and then 97.6 g of a 70% aqueous solution of (2,3-epoxypropyl)trimethylammonium chloride (0.45 mol) are slowly injected into the reaction mixture. The mixture is maintained at 40° C. for 8 h, and then cooled and neutralized using acetic acid. The polymer in then separated from the reaction mixture by precipitation in ethanol and then filtration. After drying overnight at 45° C., the product is analysed using $^1H$ NMR in $D_2O$. The proportion of grafted ammonium groups is then obtained by comparing the integral of the $CH_2$ protons of the polyvinyl alcohol (between 1.2 and 1.5 ppm) with that of the protons of the $[(CH_3)_3N^+]$ ammonium at 3.1 ppm. The $(CH_3)_3N^+$/PVOH ratio is 1:26.

Modification by Hydrophobic Units 10 g of the PVOH thus modified by units carrying a cationic functional group are introduced into an argon-purged three-necked round-bottomed flask; next, 50 ml of dimethyl sulphoxide containing 200 ppm of water are introduced. The mixture is heated at 90° C. in order to dissolve the polymer. Next, 0.585 g ($2.77\times10^{-3}$ mol) of dodecyl isocyanate is added. The reaction mixture in maintained at 90° C. for 8 hours, and then the polymer is separated by precipitation using ethyl acetate. After vacuum-drying overnight at 45° C., the product is analysed by $^1H$ NMR in $D_2O$. The proportion of grafted hydrophobic units is then obtained by comparing the integral of the $CH_2$ protons of the polyvinyl alcohol (between 1.2 and 1.5 ppm) with that of the chain-end methyl of the alkyl (at 0.8 ppm) or else with that of the methylene group of the alkyl chain in the alpha position with respect to the carbamate group (at 2.9 ppm). The content of alkyl units with respect to 100 vinyl units (monomer units) is 1%.

EXAMPLE 5

The performance of the soil-release agent prepared in Example 4 is evaluated using 0.2 g/l of water, with respect to the draining oil and a violet pigmentary soil (olive oil coloured by a violet organic pigment) the results observed on the pretreated test pieces, compared with those observed on the reference test pieces, are as follows;

| Test pieces tested | E in % Used oil | E in % Violet pigment |
|---|---|---|
| Reference test pieces | 44 | 79 |
| Treated test pieces | 58 | 88 |

What is claimed is:

1. A process for the soil-release treatment of an article based on woven cotton in an aqueous treatment medium, said cotton having a surface and a cotton/water interface, said process comprising the step of depositing, in the course of one or more washing, rinsing, softening, or drying operations, an amphiphilic soil-release agent on said article, said soil-release agent being soluble or dispersible in the treatment medium and comprising:

at least one unit carrying a functional group having a cationic character and its counter-ion, and at least one unit having a hydrophobic character, being a linear, branched or cyclic alkyl or alkenyl group containing at least 4 carbon atoms, or an aryl group, configuring said agent at the cotton/water interface, said unit having a hydrophobic character being chemically bonded to the unit carrying a functional group having a cationic character via a hydrophilic chain, consisting of similar or different hydrophilic hydrocarbon oligomer or polymer units selected from the group consisting of polysaccharides, polyalkylene glycols, polyvinyl alcohols, polyvinyl alcohols copolymers, acrylic polymers and acrylic copolymers, optionally carrying sulphonate, carboxylate or phosphate functional groups, the soil-release agent being employed during washing by means of a washing formulation, during rinsing by means of a rinsing formulation, during softening by means of a softening formulation, or during drying by means of an absorbent support.

2. A process according to claim 1, wherein the article to be treated contains at least 35% by weight of cotton.

3. A process according to claim 1, wherein the functional groups having a cationic character are ammonium, phosphonium groups, or groups derived from Lewis bases.

4. A process according to claim 1, wherein the counter-ion of the unit carrying a functional group having a cationic character is a halide, acetate, sulphate, sulphonate or phosphate ion.

5. A process according to claim 1, wherein the unit having a hydrophobic character contains from 8 to 20 carbon atoms.

6. A process according to claim 1, wherein the soil-release agent contains about 0.1 to 40% of its weight of cationic functional groups.

7. A process according to claim 1, wherein the cationic functional groups of the soil-release agent are ammonium functional groups and represent about 0.01 to 4 grams of nitrogen per 100 grams of soil-release agent.

8. A process according to claim 1, wherein the amounts of units having a hydrophobic character are such that the said soil-release agent has a hydrophilic/hydrophobic balance of greater than 15.

9. A process according to claim 1, wherein the soil-release agent is an oligomer or a polymer formed from a backbone of the hydrophilic hydrocarbon oligomer or polymer having, within its chain or as branches, the unit carrying a functional group having a cationic character with its counter-ion and the unit having a hydrophobic character.

10. A process according to claim 9, wherein the oligomeric or polymeric soil-release agent is a cationic alkyl guar or a cationic alkyl hydroxypropyl guar.

11. A process according to claim 1, wherein said soil-release agent is employed in an amount of about 0.05 to 5 grams per liter of treatment medium.

12. A process according to claim 1, wherein said soil-release agent is employed in the course of a washing operation by means of a powder or liquid washing formulation containing about 0.02 to 20% of its weight of said soil-release agent.

13. A process according to claim 1, wherein said soil-release agent is employed in the course of a rinsing or softening operation by means of a rinsing or softening formulation containing about 0.02 to 20% of its weight of said soil-release agent.

14. A process according to claim 1, wherein said soil-release agent is employed in the course of a drying operation by means of a support consisting of a strip of non-woven textile impregnated with said soil-release agent, the support containing about 20% of its weight of said soil-release agent.

15. A process for the soil-release treatment of an article based on woven cotton in an aqueous treatment medium, said cotton having a surface and a cotton/water interface, said process comprising the step of depositing, in the course of one or more washing, rinsing, softening, or drying operations, an amphiphilic soil-release agent on said article, said soil-release agent being soluble or dispersible in the treatment medium and comprising:

at least one unit carrying a functional group having a cationic character and its counter-ion, and at least one unit having a hydrophobic character, being a linear, branched, cyclic alkyl or alkenyl group containing from 8 to 20 carbon atoms, configuring said agent at the cotton/water interface, wherein said unit having a hydrophobic character is chemically bonded to the unit carrying a functional group having a cationic character via a hydrophilic chain consisting of an oligomer, polymer or copolymer of vinyl alcohol, the soil-release agent being employed during washing by means of a washing formulation, during rinsing by means of a rinsing formulation, during softening by means of a softening formulation, or during drying by means of an absorbent support, the soil-release agent consisting of an oligomer, polymer or copolymer having, within its chain or as branches, the unit carrying a functional group having a cationic character and the unit having a hydrophobic character.

16. A process according to claim 15, wherein the functional groups having a cationic character (MC) are ammonium functional groups of formula:

$$R^1R^2R^3N^+$$

wherein:

$R^1$, $R^2$ and $R^3$ are similar or different and represent H or an alkyl radical containing less than 4 carbon atoms, optionally substituted by one or more hydroxyl functional groups, or else together form, with the nitrogen atom $N^+$, at least one aromatic or non-aromatic ring, the functional groups having a cationic character being chemically bonded to the oligomer, polymer or copolymer chain of the polyvinyl alcohol directly by a C—C bond or indirectly via a divalent or polyvalent hydrocarbon group containing at least one heteroatom.

17. A process according to claim 16, wherein the ammonium functional groups derive from glycidyltrimethylammonium chloride, glycidyltrimethylammonium bromide, or (1-chloro-2-hydroxypropyl)trimethyl-ammonium chloride.

18. A process according to claim 16, wherein the units having a hydrophobic character are linear or branched alkyl radicals chemically bonded to the oligomer, polymer or copolymer chain of the polyvinyl alcohol directly by a C—C bond or indirectly via a divalent or polyvalent hydrocarbon group containing at least one heteroatom.

19. A process according to claim 16, wherein the soil-release agent contains about 0.1 to 10 units carrying a functional group having a cationic character per 100 monomer units of the oligomer, of the polymer or of the copolymer of polyvinyl alcohol and from 0.01 to 10 units having a hydrophobic character per 100 monomer units of the polyvinyl alcohol polymer or copolymer.

20. A process for the soil-release treatment of an article based on woven cotton in an aqueous treatment medium, said cotton having a surface and a cotton/water interface, said process comprising the steps of:

a) depositing, in the course of one or more washing, rinsing, softening, or drying operations, an amphiphilic soil-release agent on said article, said soil-release agent being soluble or dispersible in the treatment medium and comprising:

at least one unit carrying a functional group having a cationic character and its counter ion, and at least one unit having a hydrophobic character, being a linear, branched, cyclic alkyl or alkenyl group containing at least 4 carbon atoms, or an aryl group, configuring said agent at the cotton/water interface, said unit having a hydrophobic character being chemically bonded to the unit carrying a functional group having a cationic character via a hydrophilic chain, consisting of similar or different hydrophilic hydrocarbon oligomer or polymer units selected from the group consisting of polysaccharides, polyalkylene glycols, polyvinyl alcohols, polyvinyl alcohols copolymers, acrylic polymers and acrylic copolymers, optionally carrying sulphonate, carboxylate or phosphate functional groups, the soil-release agent being employed during washing by means of a washing formulation, during rinsing by means of a rinsing formulation, during softening by means of a softening formulation, or during drying by means of an absorbent support, and b) removing said soil-release agent during the next washing at the same time as the soil.

* * * * *